US007137960B2

(12) United States Patent
Tien

(10) Patent No.: US 7,137,960 B2
(45) Date of Patent: Nov. 21, 2006

(54) MANUAL MASSAGER

(76) Inventor: Tien-Jen Tien, No. 55-1, Lioujhih Lane, Lioufen Rd., Waipu Township, Taichung County (TW)

( * ) Notice: Subject to any disclaimer, the term of this patent is extended or adjusted under 35 U.S.C. 154(b) by 156 days.

(21) Appl. No.: 10/899,704

(22) Filed: Jul. 26, 2004

(65) Prior Publication Data

US 2006/0020232 A1 Jan. 26, 2006

(51) Int. Cl.
*A61H 7/00* (2006.01)

(52) U.S. Cl. ..... 601/135; 601/118; 601/120; 601/137

(58) Field of Classification Search ..... 601/118–120, 601/122, 123, 125, 128, 129, 134, 135, 136, 601/137; 606/201, 204, 237, 238; D24/211, D24/214

See application file for complete search history.

(56) References Cited

U.S. PATENT DOCUMENTS 3,625,204 A * 12/1971 Sekiguchi ..... 601/134
3,831,592 A * 8/1974 Lancellotti ..... 601/135
4,345,757 A * 8/1982 Lo Voi ..... 601/120
4,433,683 A * 2/1984 McCoy et al. ..... 601/120
4,492,223 A * 1/1985 Burke ..... 601/129

* cited by examiner

*Primary Examiner*—Quang D. Thanh
(74) *Attorney, Agent, or Firm*—Alan D. Kamrath; Nikolai & Mersereau, P.A.

(57) ABSTRACT

A manual massager includes a shank having a cavity defined in a first end thereof and two legs extending from a second end thereof. A tapered stub is movably and partially received in the first end of the shank for pressing the points at which a person is supposed to be lethally vulnerable. A ball is rotatably and partially received in a free end of each of the two legs for abutting and rotating on the user's skin. A fin extends from an outer periphery of the shank near the first end of the shank for providing a popular treatment for sunstroke by scraping the user's neck and back.

4 Claims, 7 Drawing Sheets

MANUAL MASSAGER

BACKGROUND OF THE INVENTION

1. Field of the Invention

The present invention relates to a manual massager, and more particularly to a manual massager that is multi-functional.

2. Description of Related Art

A conventional manual massager in accordance with the prior art shown in FIG. 7 comprises an L-shaped shank (20) having a first end and a second opposite to each other. An enlarged grip (21) is formed on the first end and an enlarged head (22) is formed on the second end. A socket (24) is defined in the enlarged head (22) for rotatably receiving a ball (24) in the enlarged head (22). The ball (24) partially extends out of the enlarged head (22).

The user holds the grip (21) and press the shank (20) to make the ball (24) abut against the user's skin. The conventional massager is reciprocally moved and the ball (24) is rotated to achieve the purpose of massage.

However, the conventional massager has only one ball (24) for massaging such that the massage area of the conventional massager is small. In addition, the conventional massager has only function that needs to be advantageously altered.

The present invention has arisen to mitigate and/or obviate the disadvantages of the conventional manual massager.

SUMMARY OF THE INVENTION

The main objective of the present invention is to provide an improved manual massager that is multi-functional.

To achieve the objective, the manual massager in accordance with the present invention comprises a shank having a cavity defined in a first end thereof and two legs extending from a second end thereof. A tapered stub is movably and partially received in the first end of the shank for pressing the points at which a person is supposed to be lethally vulnerable. A ball is rotatably and partially received in a free end of each of the two legs for abutting and rotating on the user's skin. A fin extends from an outer periphery of the shank near the first end of the shank for providing a popular treatment for sunstroke by scraping the user's neck and back.

Further benefits and advantages of the present invention will become apparent after a careful reading of the detailed description with appropriate reference to the accompanying drawings.

DETAILED DESCRIPTION OF THE INVENTION

Figure 1D:
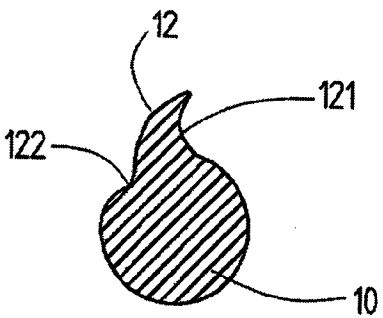
FIG. 1D is a cross sectional view of the manual massager according to section line D-D in FIG. 1.
Figure 1:
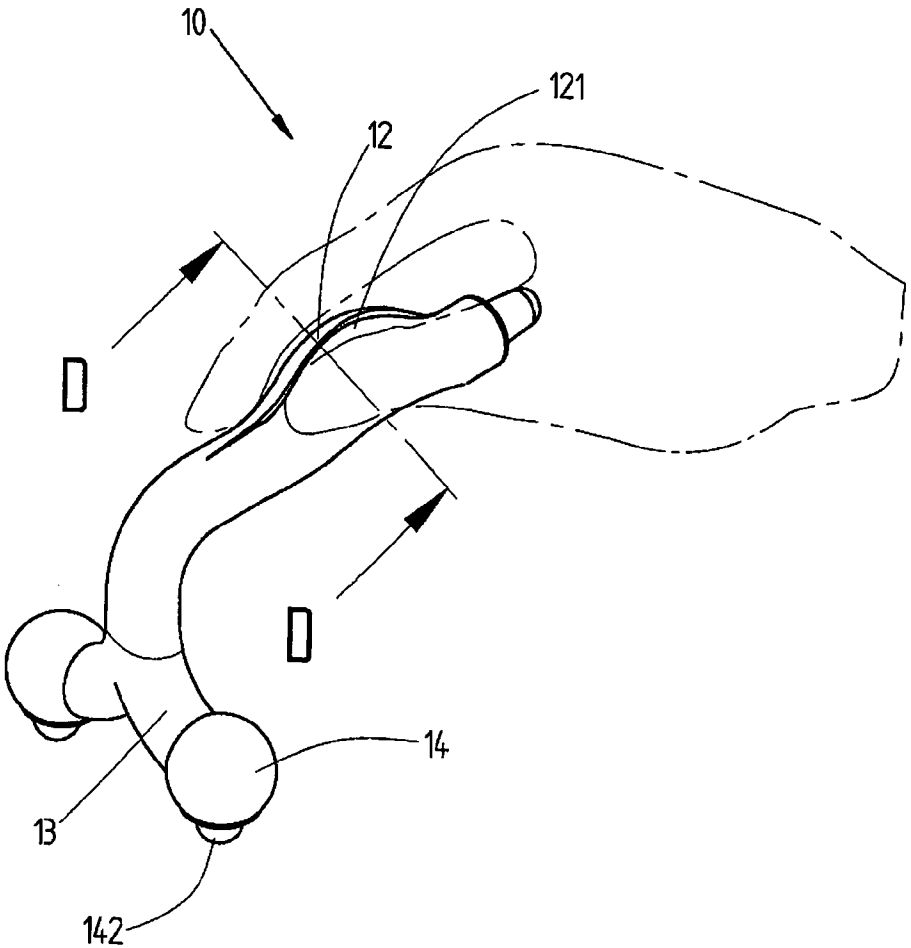
FIG. 1 is a perspective view of a manual massager in accordance with the present invention.
Figure 2:
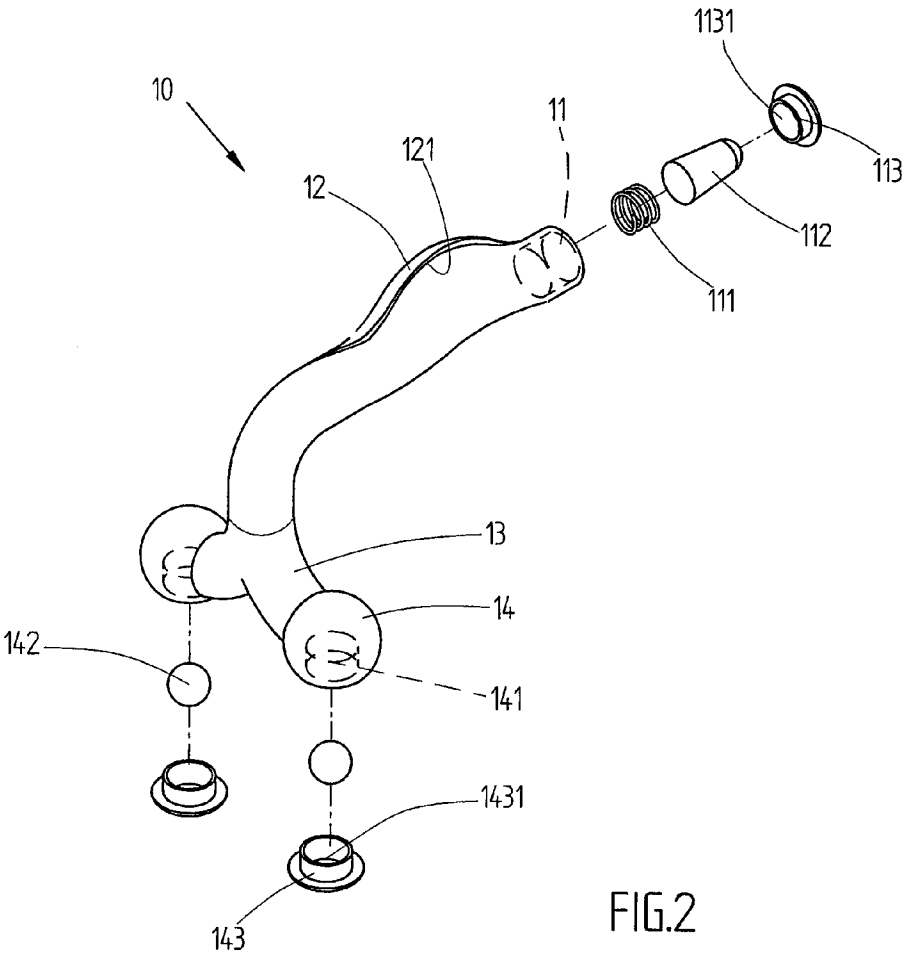
FIG. 2 is an exploded perspective view of the manual massager in FIG. 1.
Figure 3:
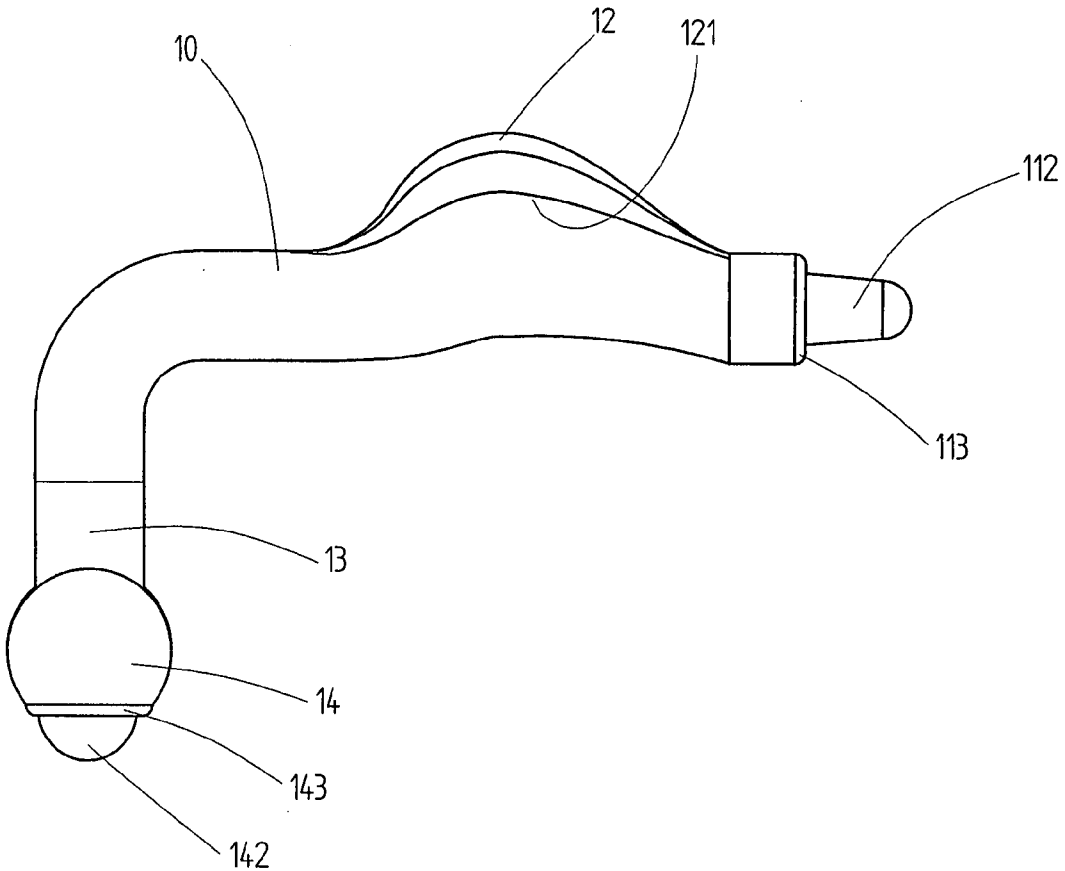
FIG. 3 is a side plan view of the manual massager in FIG. 1.
Figure 4A:
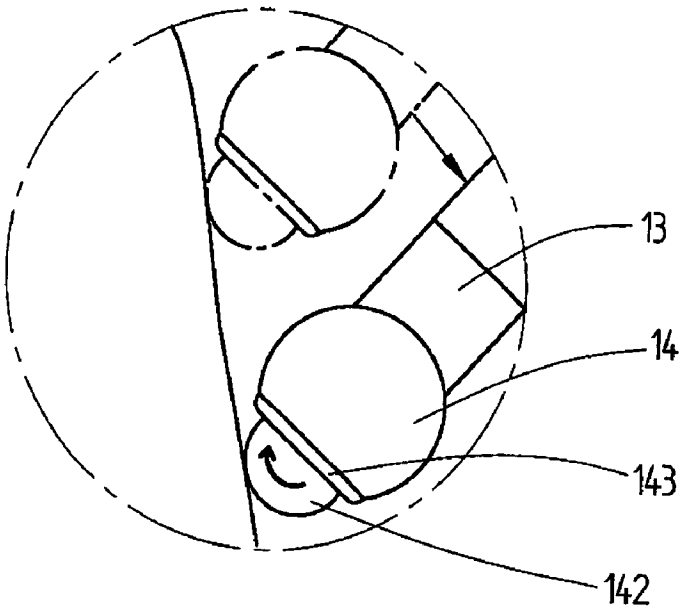
FIG. 4A is an enlarged operational view of the manual massager of the encircled area A in FIG. 4.
Figure 4:
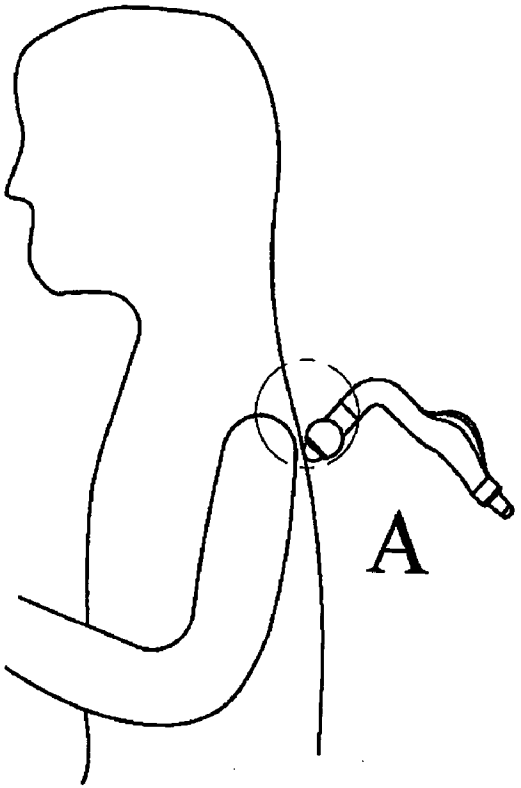
FIG. 4 is a first operational view of the manual massager of the present invention.

Referring to the drawings and initially to FIGS. 1–3, a manual massager in accordance with the present invention comprises an L-shaped shank (10) having a first end and a second end. A cavity (11) is longitudinally defined in the first end of the shank (10). A spring (111) is compressively received in the cavity (11) and a tapered stub (112) is partially received in the cavity (1). The tapered stub (112) has an enlarged end abutting the spring (111). A first end-piece (113) is longitudinally mounted to the first end of the shank (10) to prevent the tapered stab (112) from detaching from the cavity (11) such that the tapered stub (112) is movable relative to the first end-piece (113). A first through hole (1131) is defined in the first end-piece (113) to allow the tapered stub (112) extending through the first end-piece (113). The first through hole (1131) has a shape corresponding to that of the tapered stab (112). A fin (12) extends from an outer periphery of the shank (10) near the first end of the shank (10). A raised portion (121) is formed on a top of the fin (12) and an indentation (122) is defined between the fin (12) and the shank (10).

Two legs (13) respectively laterally extend from the second end of the shank (10) opposite to each other. A balled portion (14) is formed on a free end of each of the two legs (13). Each balled portion (14) has a recess (141) defined therein and opened in a bottom of each of the two balled portions (14). A ball (142) is rotatably received in a corresponding one of the two recesses (141) and a second end-piece (143) is mounted to a corresponding one of the two balled portions (14) to hold the ball (142) in place. A second through hole (1431) is defined in each of the two second end-pieces (143) to allow the ball (142) partially extending through the second end-piece (143).

Figure 5B:
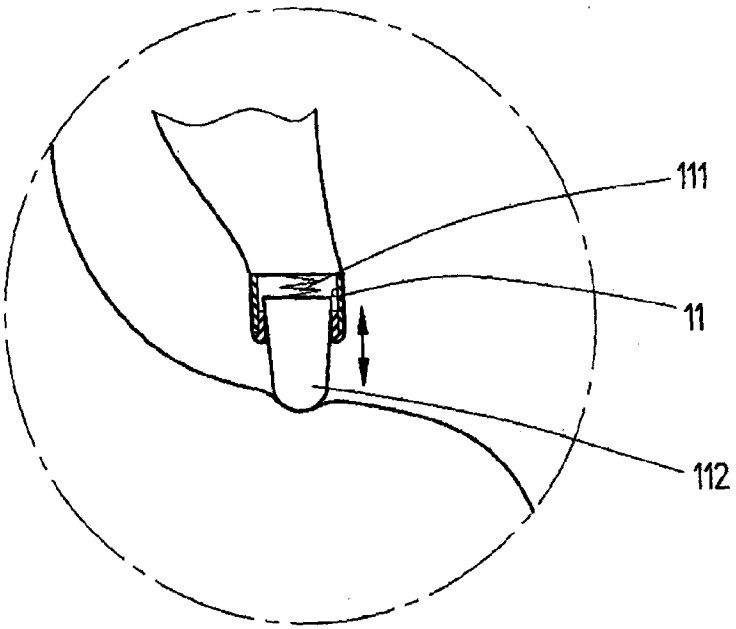
FIG. 5B is an enlarged operational view of the manual massager of the encircled area B in FIG. 5.
Figure 5:
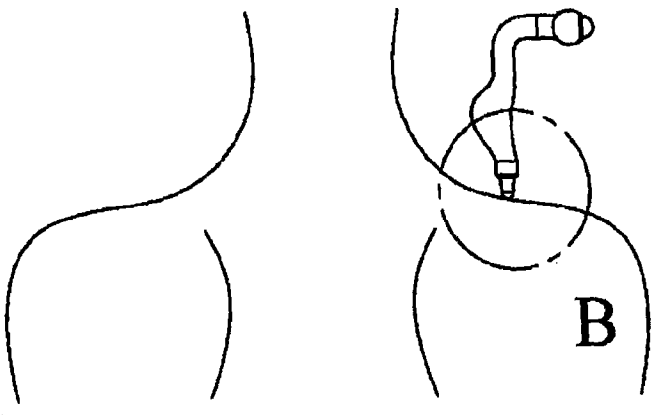
FIG. 5 is a second operational view of the manual massager of the present invention.

With reference to FIG. 5, the manual massager of the present invention has two balls (142) that abut and rotate on the user's skin such that the manual massager has a massage area greater than that of the conventional manual massager.

Figure 6C:
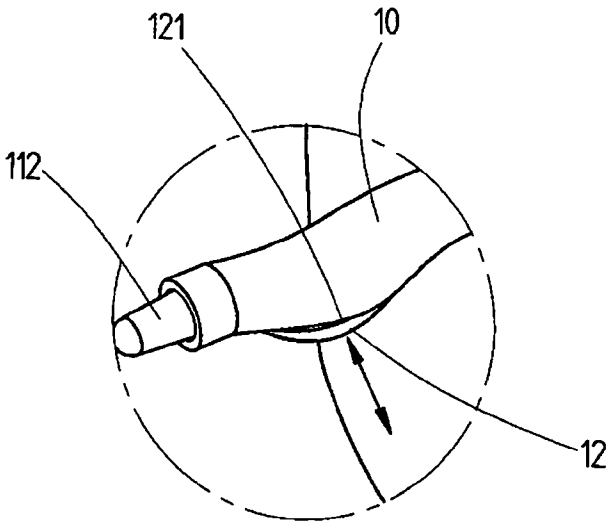
FIG. 6C is an enlarged operational view of the manual massager of the encircled area C in FIG. 6.
Figure 6:
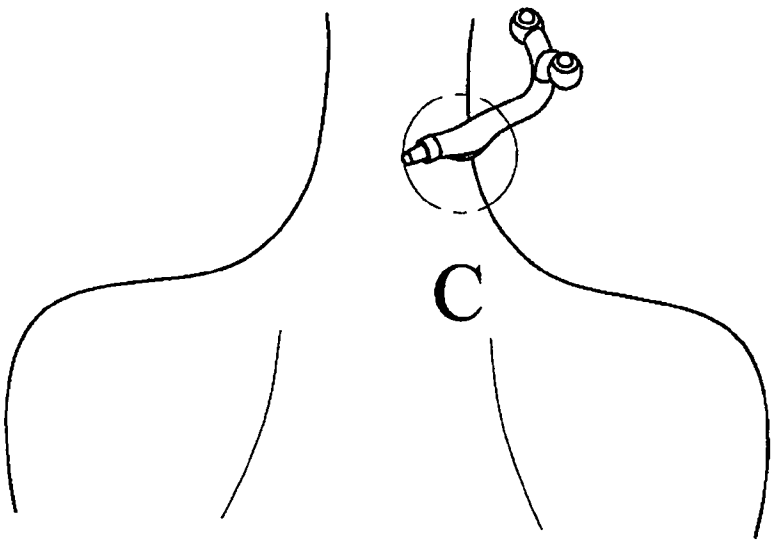
FIG. 6 is a third operational view of the manual massager of the present invention.
Figure 7:
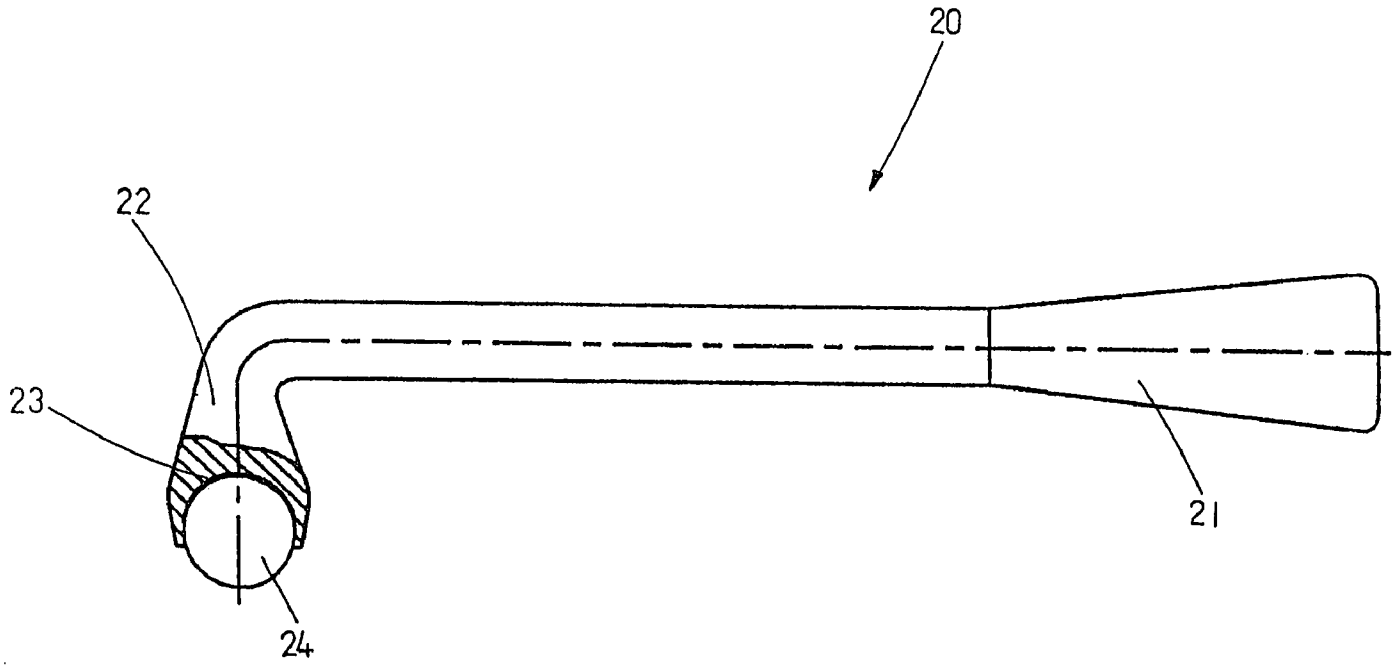
FIG.7 PRIOR ART
FIG. 7 is a side plan view of a conventional manual massager in accordance with the prior art.

With reference to FIG. 6, the tapered stub (112) extends through the first end-piece (113) and reciprocally moved relative to the restitution force of the spring (111). The spring (111) provides a buffer effect when the tapered stub (112) is used to press the points at which a person is supposed to be lethally vulnerable.

The fin (12) provides an effect of anti-slip when massaging and can be used to popular treatment for sunstroke by scraping the user's neck and back.

Although the invention has been explained in relation to its preferred embodiment, it is to be understood that many other possible modifications and variations can be made without departing from the spirit and scope of the invention as hereinafter claimed.

What is claimed is:

1. A manual massager comprising an L-shaped shank having a first end and a second end, a cavity longitudinally defined in the first end of the shank, a spring compressively received in the cavity and a tapered stub partially received in the cavity, the tapered stub having an enlarged end abutting the spring, a first end-piece longitudinally mounted to the first end of the shank to prevent the tapered stub from detaching from the cavity such that the tapered stub is movable relative to the first end-piece, a first through hole defined in the first end-piece to allow the tapered stub extending through the first end-piece and press the points at which-a person is supposed to be lethally vulnerable, a fin extending from an outer periphery of the shank near the first end of the shank, a raised portion formed on a top of the fin and an indentation defined between the fin and the shank such that the fin used to provide a popular treatment for sunstroke by scraping the user's neck and back.

2. The manual massager as claimed in claim 1 further comprising two legs respectively laterally extending from the second end of the shank opposite to each other, a balled portion formed on a free end of each of the two legs and each balled portion having a recess defined therein and opened in a bottom of each of the two balled portions, a ball rotatably received in a corresponding one of the two recesses and a second end-piece mounted to a corresponding one of the two balled portions to hold the ball in place, a second through hole defined in each of the two second end-pieces to allow the ball partially extending through the second end-piece to abut and rotate on the user's skin.

3. The manual massager as claimed in claim 1, wherein the first through hole has a shape corresponding to that of the tapered stub.

4. The manual massager as claimed in claim 2, wherein the first through hole has a shape corresponding to that of the tapered stub.

* * * * *